US006982654B2

(12) United States Patent
Rau et al.

(10) Patent No.: US 6,982,654 B2
(45) Date of Patent: Jan. 3, 2006

(54) AUTOMATED LICENSE PLATE RECOGNITION SYSTEM FOR USE IN LAW ENFORCEMENT VEHICLES

(76) Inventors: William D. Rau, 35 Allard Blvd., New Orleans, LA (US) 70119; Nathan M. Rau, 9345 Rath Pl., Eden Prairie, MN (US) 55347

( * ) Notice: Subject to any disclaimer, the term of this patent is extended or adjusted under 35 U.S.C. 154(b) by 43 days.

(21) Appl. No.: 10/713,995

(22) Filed: Nov. 14, 2003

(65) Prior Publication Data

US 2004/0104813 A1 Jun. 3, 2004

Related U.S. Application Data

(60) Provisional application No. 60/426,235, filed on Nov. 14, 2002.

(51) Int. Cl.
*G08G 1/017* (2006.01)

(52) U.S. Cl. ..... 340/937; 340/539.1; 340/901; 348/148

(58) Field of Classification Search ..... 340/425.5, 340/937, 933, 901, 905, 539.1, 539.16; 348/148
See application file for complete search history.

(56) References Cited

U.S. PATENT DOCUMENTS 3,656,111 A * 4/1972 Royster, Sr. ..... 340/825.37
5,083,200 A * 1/1992 Deffontaines ..... 348/148
5,568,406 A * 10/1996 Gerber ..... 702/159
6,188,939 B1 * 2/2001 Morgan et al. ..... 701/36
6,262,764 B1 * 7/2001 Perterson ..... 348/148
6,433,706 B1 8/2002 Anderson, III et al. ..... 340/937
6,437,690 B1 8/2002 Okezie ..... 340/505
6,894,717 B2 * 5/2005 Bakewell ..... 340/937
2002/0093419 A1 * 7/2002 Nakayama et al. ..... 340/426
2003/0095688 A1 5/2003 Kirmuss ..... 382/105
2004/0199785 A1 * 10/2004 Pederson ..... 713/200
2004/0218785 A1 * 11/2004 Kim ..... 382/105

* cited by examiner

*Primary Examiner*—Thomas Mullen
(74) *Attorney, Agent, or Firm*—Westman, Champlin & Kelly, P.A.

(57) ABSTRACT

The present invention is directed to a law enforcement vehicle 100 having a camera 210 mounted to a portion of the vehicle 100. Camera 210 is configured to identify a license plate 260 on a vehicle that is viewed, and provides an output signal 214 indicative of the identified license plate 160 to a processor 220 carried on the vehicle 100. Processor 220 is configured to receive the signal 214 from camera 210, and compares the received signal 214 with a list of stolen vehicle license plates contained in a database 232. The processor 220 also accesses a storage device 230 containing database 232 of stolen vehicle license plates. The processor 220 is further configured to provide an output signal 228 to an output device 240. Output device 240 is configured to provide an output that is detectable by the law enforcement officer, indicating to the law enforcement officer that there is a match. In another embodiment the system is configured to detect a license plate while the law enforcement vehicle is in motion.

20 Claims, 7 Drawing Sheets

Fig. 6A
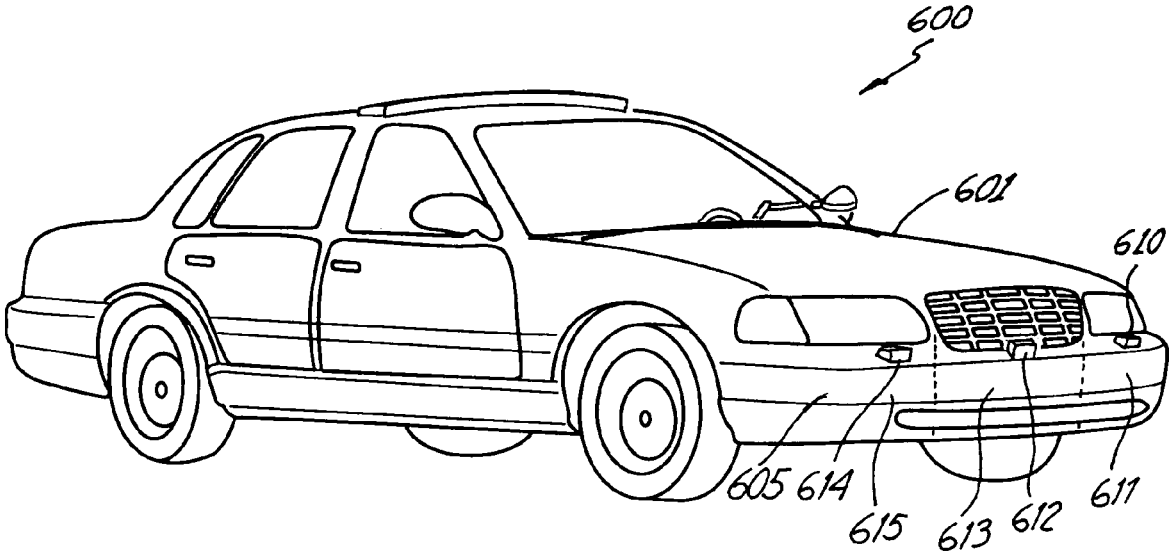
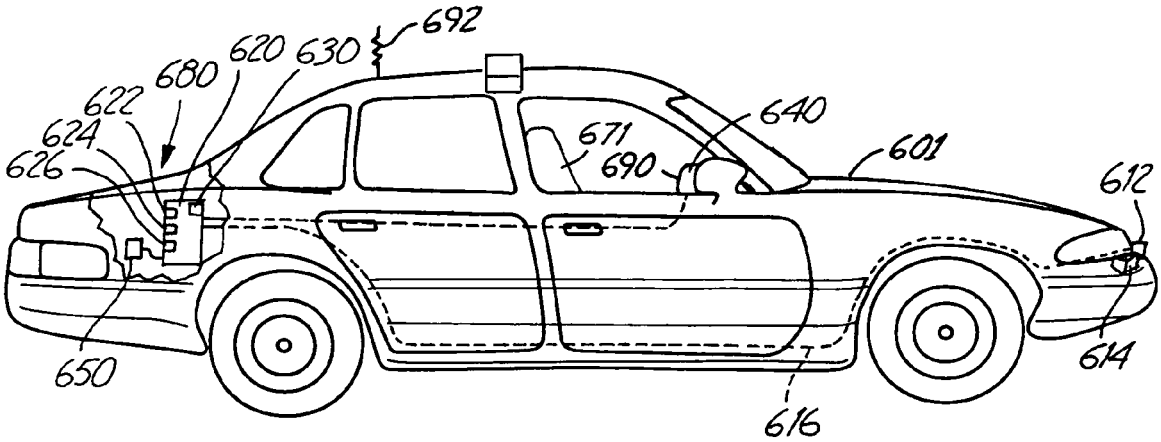
Fig. 6B

AUTOMATED LICENSE PLATE RECOGNITION SYSTEM FOR USE IN LAW ENFORCEMENT VEHICLES

The present application is based on and claims the benefit of U.S. provisional patent application Ser. No. 60/426,235, filed Nov. 14, 2002, the content of which is hereby incorporated by reference in its entirety.

BACKGROUND OF THE INVENTION

The present invention is directed towards recovering stolen vehicles, and more particularly towards identifying a stolen vehicle in the public space.

Automobile theft is a leading cause of loss among the insurance industry, costing consumers more than $7.5 billion per year. The National Insurance Crime Bureau (NICB) reported in 2001 that an estimated 5 million vehicles are stolen worldwide each year. Approximately 1.2 million of those vehicles were stolen in the United States alone or one every 25 seconds. In other words one out of every 170 registered vehicles in the United States is stolen every year.

Vehicles are stolen for a variety of reasons, for example, for their parts, to be exported to a foreign country, or to be used in the commission of other crimes. In the United States stolen vehicles are recovered approximately 65% of the time. Over the past decade this rate has steadily declined, as car theft has become a major focus of organized crime. If car theft were a legitimate business it would rank in the top 60 of the nations largest businesses.

Vehicle theft is not just a property crime. To many people, the theft of a vehicle has a major impact on their lives. It affects them beyond the loss of vehicle. Often, they feel victimized and vulnerable, while at the same time they must cope with the inconvenience, time-consuming, and costly process of recovering or replacing their stolen vehicle.

With the advent of vehicle tracking systems, such as LOJACK® and ONSTAR®, car thieves have changed their practices in handling vehicles they have recently stolen. In areas where LOJACK® is available, thieves will often steel a vehicle and take it to a location away from their base of operations, park the car and wait. After the vehicle has sat for a couple of days, the thieves return to the car and take it wherever they had intended to when the vehicle was originally stolen. A primary reason car thieves use a "park and wait" approach is to ensure that the vehicle just stolen does not have a tracking system, which could alert law enforcement to the criminals' base of operations. If the vehicle is still in the location where the thieves left it, the thief assumes the vehicle most likely does not have a tracking device, and is therefore a clean car.

Law enforcement officers, and police departments can only dedicate so much of their time and resources to tracking down stolen vehicles. In large cities with high crime rates, such as New Orleans, La., law enforcement officers have to deal with a vast number of crimes, many of which are more violent in nature than car theft, such as murder and rape. A law enforcement officer, while on a routine patrol in an area may pass a number of stolen vehicles parked on the street, or driving down the street. Unless the officer has a photographic memory he may not even realize that the vehicle he has just encountered is in fact stolen.

Therefore a system is needed to alert the officer that a stolen vehicle is in the vicinity of the officer. Furthermore, as vehicle tracking is not available in all areas, an is an expensive option a system is needed that will improve the likelihood of recovering a stolen vehicle even if the vehicle is not fitted with a tracking system.

SUMMARY OF THE INVENTION

The present invention is directed to a law enforcement vehicle having at lease one camera mounted to a portion of the vehicle. The camera is configured to identify a license plate on a vehicle that is currently within the field of view of the camera. The camera can in various embodiments capture the image of the license plate while the vehicle is in motion, or can be used in a stationary environment. The camera provides an output signal indicative of the identified license plate as a digital image. This image is then provided to a processor stored on the vehicle. The camera can be mounted on several different locations on the vehicle. In one embodiment the cameras are mounted on font bumper of the vehicle. In another embodiment the cameras are integrated into the "A" pillar of the vehicle. In yet another embodiment the cameras are installed on the dashboard of the vehicle.

The Processor receives the signal or image from camera, and interprets from the image the characters that comprise the license plate. In other embodiments the processor can interpret for the received image other features of the vehicle. These features can include the make, model, type and colour of the vehicle. The processor then takes the recognized characters on the license plate and compares them with a list of stolen vehicle license plates contained in a database. The processor accesses through a storage device, such as a hard drive, the database of stolen vehicle license plates. The processor further provides an output signal to an output device when the processor identifies a match between the identified characters of the license plate and a plate in the database.

The output device provides an output that is detectable by the law enforcement officer, indicating to the law enforcement that a there is a match with an entry in the database. This output can be a visual output or an audible output. In one embodiment of the present invention the output of the system is displayed on a display device that provides the officer with more detailed information related to the identified license plate. In another embodiment the officer is presented with a lighted display that indicates to the officer that a match has been detected.

BRIEF DESCRIPTION OF THE DRAWINGS

FIGS. 6A and 6B are an illustrative example of a law enforcement vehicle having multiple cameras in accordance with one teaching of the present invention.

DETAILED DESCRIPTION OF THE PREFERRED EMBODIMENTS

Figure 1:
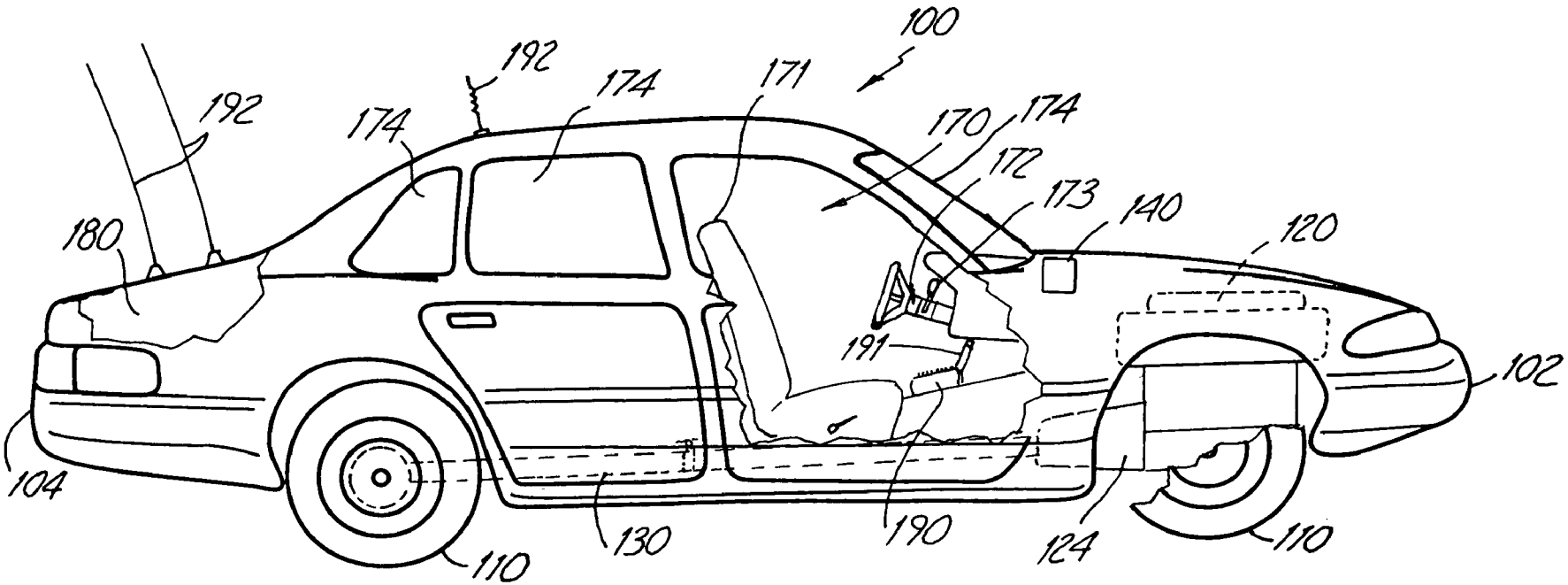
FIG. 1 is a diagrammatic illustration of a law enforcement vehicle in which the present invention is useful.

FIG. 1 is a diagrammatic illustration schematically illustrating a law enforcement vehicle 100 environment in which the present invention is particularly useful. Law enforcement vehicle 100 is a motorized vehicle typically used in everyday law enforcement activities. Law enforcement vehicle 100 includes an engine 120, a drive train 130, a battery 140, an occupant compartment 170, a storage or trunk area 180, and a communication system 190.

Engine 120 provides mechanical power to drive train 130 to propel law enforcement vehicle 100 on a highway or other road surface. Engine 120 is in one embodiment an internal combustion engine using gasoline. However engine 120 can use diesel fuel, or engine 120 can be an electrical motor powered by batteries carried in law enforcement vehicle 100, or can be any other device or system that can provide energy to propel law enforcement vehicle 100. Engine 120 provides power to the wheels through drive train 130 by a mechanical transfer of energy. This transfer of energy can be done through the use of gears in a transmission 124. However, other means of transferring energy from engine 120 to drive train 130 can be used such as chains, or direct drive.

Occupant compartment 170 (shown in cut out) provides an area or space for a law enforcement officer to sit and operate vehicle 100. Compartment 170 has a driver's seat 171, a steering column and wheel 172, and a transmission control device 173. A law enforcement officer sits in seat 171 while operating vehicle 100 and is restrained by a seat belt (not illustrated). Occupant compartment 170 has a plurality of windows that allow the officer to view the surrounding area without exposure to the natural elements. Windows are commonly made of transparent safety glass, but can be comprised of any transparent material that provides protection from the elements, such as Plexiglas®.

Storage area 180 (also shown in cut out) is located near the rear portion 104 of law enforcement vehicle 100. In one embodiment storage area 180 is closed to the occupant compartment 170, as in a typical sedan, such as a Ford Crown Victoria. However, storage area 180 can be open to the occupant compartment 170, as in a typical sport utility vehicle or a station wagon, such as a Ford Explorer or Volvo V70. Storage area 180 provides an area to store tools and equipment commonly used in everyday law enforcement, such as flares, weapons, chalk, and form papers. When storage compartment 180 is open to occupant compartment 170, a cover can be provided to shield the contents of the storage compartment 180 from outside view. In other embodiments, storage compartment 180 can be located in other areas of the vehicle 100.

Vehicle 100 is also fitted with a communication system 190. Communication system 190 allows the law enforcement officer to communicate with other officers as well as a central dispatch center. In one embodiment communications system 190 include a radio transmitter and an antenna 192 for transmitting voice information using radio technology. However, other forms of transmitting information can be used such as cellular technology, using for example General Packet Radio Service (GPRS), to transmit both voice and data. Further other forms of information can be transmitted via communicators system 190.

Figure 2:
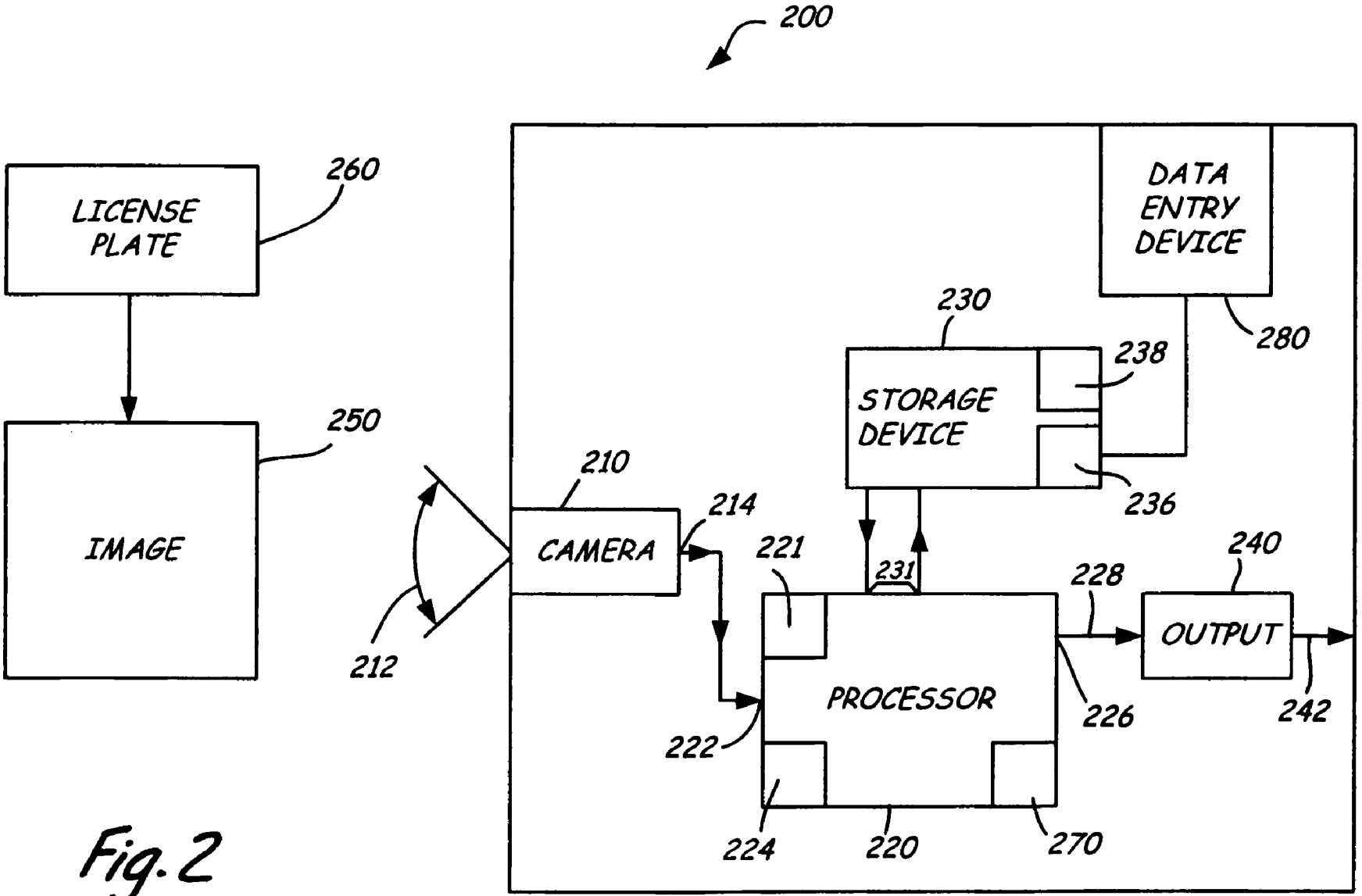
FIG. 2 is a block diagram illustrating the components of the present invention.

FIG. 2 is a block diagram illustrating a law enforcement vehicle 100 including an imaging system 200 according to one embodiment of the present invention. Law enforcement vehicle 100 is similar to the vehicle illustrated in FIG. 1. This imaging system 200 includes a camera 210, a processor 220, a storage device 230, and an output 240. The law enforcement vehicle 100 is configured to capture an image 250 of a license plate 260 and compare image 250 of license plate 260 with a database 236 of license plates.

Camera 210 is connected to processor 220 and is configured to take an image 250 of an area with in a field of view 212 and to provide an image 250 to the processor 220. In one embodiment camera 210 is located on a front portion 102 (FIG. 1) of the law enforcement vehicle 100. However, other locations on vehicle 100 can be used. Camera 210 is positioned on the front portion 102 of the law enforcement vehicle 100 such that the camera 210 is able to capture the image 256 of a license plate 260 of a vehicle when the license plate 260 is within the field of view 212 of the camera. Further, placing or locating camera 210 at the front of law enforcement vehicle 100 reduces the likelihood that camera 210 has an obstructed view caused by various parts of the vehicle 100 such as lights or wipers.

In one embodiment camera 210 is a digital camera that takes image 250 in a digital format. However, camera 210 can be any other device capable of providing an image in a format understandable by processor 220. Camera 210 captures a picture or image 250 of a vehicle in front of law enforcement vehicle 100, and converts image 250 to a digital format. The digital version of image 250 is provided to the processor 220 through camera output 214. However, in alternative embodiments the conversion of image 250 to a digital format can be done by processor 220. Camera 210 can be configured to capture an image 250 when law enforcement vehicle 100 is in motion, it can be configured to capture image 250 when stationary, or both.

Processor 220 is connected to camera 210, storage device 230, and output device 240. Processor 220 is configured to analyze the image 250 to determine if the image 250 represents a stolen vehicle. In an alternative embodiment, processor 220 can also determine if the image 250 does not match characteristics of the vehicle scanned (i.e., the plate is on the wrong vehicle). In one embodiment processor 220 is a microprocessor. However, processor 220 can be a computer, a plurality of microprocessors, a portable desktop assistant (PDA), or any other device that is capable of processing an image 250 received from the camera 210 and comparing that image with information stored in a database. Depending on the physical size of processor 220 and the needs of the jurisdiction, processor 220 can be located in the occupant compartment 170 or in the storage compartment 180 of the law enforcement vehicle 100. However other locations in law enforcement vehicle 100 are possible.

Processor 220 includes an input 222 where the image 250 is received from camera 210. Processor 220 also includes an input/output 224 where processor 220 accesses or stores information on a storage device 230. Finally, processor 220 includes an output 226 that provides an output signal 228 to the output device 240. In one embodiment the output signal 228 is provided when the processor 220 has found a match between image 250 received from the camera 210 and a stored image. However, an output signal 228 can be provided for all images received, or only for those received images that matched a stored image and exceed a predetermined threshold value.

Processor 220 also includes at least two routines or programs for analyzing received image 250. These routines include an analysis routine 221 and a comparing routine 270. Analysis routine 221 is a computer program containing instructions which are executed by the processor 220 when an image 250 is received. Analysis routine 221 is programmed to identify letters and numbers that are contained within the image 250. Analysis routine 221 also includes instructions to note or determine the location of each identified letter and number on the image 250. Based on the location of each letter and number determined by analysis routine 221, analysis routine 221 determines the complete license plate number 260 contained in the scanned image 250. Analysis routine 221 also includes instructions to determine the state, province, or country of the license plate 260. Analysis routine 221 can identify the letters and numbers in the image 250 through the use of character recognition that is based upon variations in color tones of image 250, optical character recognition (OCR) protocols, or any other method for identifying letters and character strings in an image. In other embodiments analysis routing can identify a bar code or other identifications in the image 290. Analysis routine 221 then converts this identified number to a format that is useable by comparing routine 270 when comparing the license plate number 260 with the information stored in database 236. The operation of the comparing routine 270 will be described in further detail below.

Storage device 230 is connected to the processor 220 through the input/output 231 and provides the processor 220 with data related to stolen vehicles and their associated license plates when processor 220 processes image 250. Storage device 230 can be a short-term memory device such as RAM or a long-term permanent memory system such as ROM, a hard disc, flash memory (DRAM, DVD) or other known storage elements. Storage device 230 is in one embodiment a computer hard disc drive having 100 gigabytes (GB) of storage space. However, other storage sizes can be used. Storage device 230 is configured to hold a database 236 containing information related to stolen vehicles and their associated license plates. Further, database 236 can include a database of all registered vehicle in the jurisdiction where the law enforcement vehicle 100 is located. However, other databases of registered vehicles can be used, such as for an entire state, province, or country and can also include a database of stolen license plates. In another embodiment storage device 230 is further configured to store the image 250 when processor 220 identifies a match in a match database 238.

Storage device 230 and database 236 are configured to be updated using a data input device 280. Data input device can be a CD ROM drive, a floppy disc drive, a USB port, a serial port or any other input device or protocol. In one embodiment database 236 is updated daily using a CD containing new information for database 236 that is placed in data input device 280. However, other formats can be used for updating database 236 such as plugging system 200 into a host computer (not shown), or continuously by using communications system 190, as will be discussed in FIG. 7.

Database 236 is computer-generated database of information related to stolen vehicles. Database 236 can be a database of stolen vehicles maintained by the local jurisdiction. However, other databases may be used, such as a national database of stolen vehicles, or an insurance database. Database 236 includes information related to each stolen vehicle contained in database 236. This information can include, make, model, year, color, owners name, and owners address. However, more or less information can be provided in database 236. Further, database 236 can include a list of license plates that have been stolen without the vehicle being stolen. The information included in database 236 for stolen plates include the same information provided for the stolen vehicles.

The output device 240 is connected to the processor 220 at 226 and is configured to provide an output 242 in response to a signal 228 from processor 220. In one embodiment, output device 240 is a visual output indicating to the law enforcement officer that the processor 220 has identified a match. This visual output signal can be a single light, a red/green light, or any other visual indicator. In another embodiment output device 240 is a computer screen (illustrated in FIG. 4) which provides the officer with the information contained in database 236 regarding the stolen vehicle when a match has been made with database 236. In yet another embodiment, output device 240 is configured to provide an audible output in response to signal 228 received from processor 220. This audible output can be a bell, a buzzer or a synthesized voice. However, other audible outputs can also be used. Further, output 240 can provide both audible and visual outputs in response to a signal 228 from the processor 220. Output device 240 can also be configured to communicate with a central station (FIG. 7) allowing communication to the central station that the law enforcement vehicle has encountered and identified a match with a license plate 260 in database 236.

In operation, according to one illustrative embodiment, the law enforcement vehicle 100 is driven down a public street. Camera 210 constantly, (or at a predetermined rate) takes images 250 of vehicles it encounters on the road or highway according to a predetermined protocol. When camera 210 takes an image 250 of a vehicle license plate 260, image 250 is converted into a digital format. The digital image 250 is sent to processor 220 for analysis with information continued in database 236. Processor 220 processes image 250 using the analysis routine 221 to identify a portion of the image 250 that is representative of license plate number 260. Processor 220 then passes the license plate number 260 to the comparing routine 270, and stores the license plate number 260 in a temporary storage device 224 that is part of the processor 220. However, this temporary storage can be located elsewhere Following the execution of the analysis routine 221, processor 220 accesses the stolen vehicle database 236 from the storage device 230. Using the comparing routine 270, comparing routine 270 compares the license plate number 260 with the listing of license plate numbers in stolen vehicle database 236. If comparing routine 270 finds a match between the license plate number 260 and a license plate number in database 236 that is listed as stolen, processor 220 provides output signal 228 to output device 240, indicating to the law enforcement officer that a match with the database has occurred. Further, processor 220 stores in a match database 238 a copy of the image 250 for later use and recall. If there is no match between license plate 260 and a license plate in database 236, then no output signal is sent to output device 240. In other embodiments, processor 220 provides an output signal 228 to output device 240 indicating that a match was not found.

Figure 3:
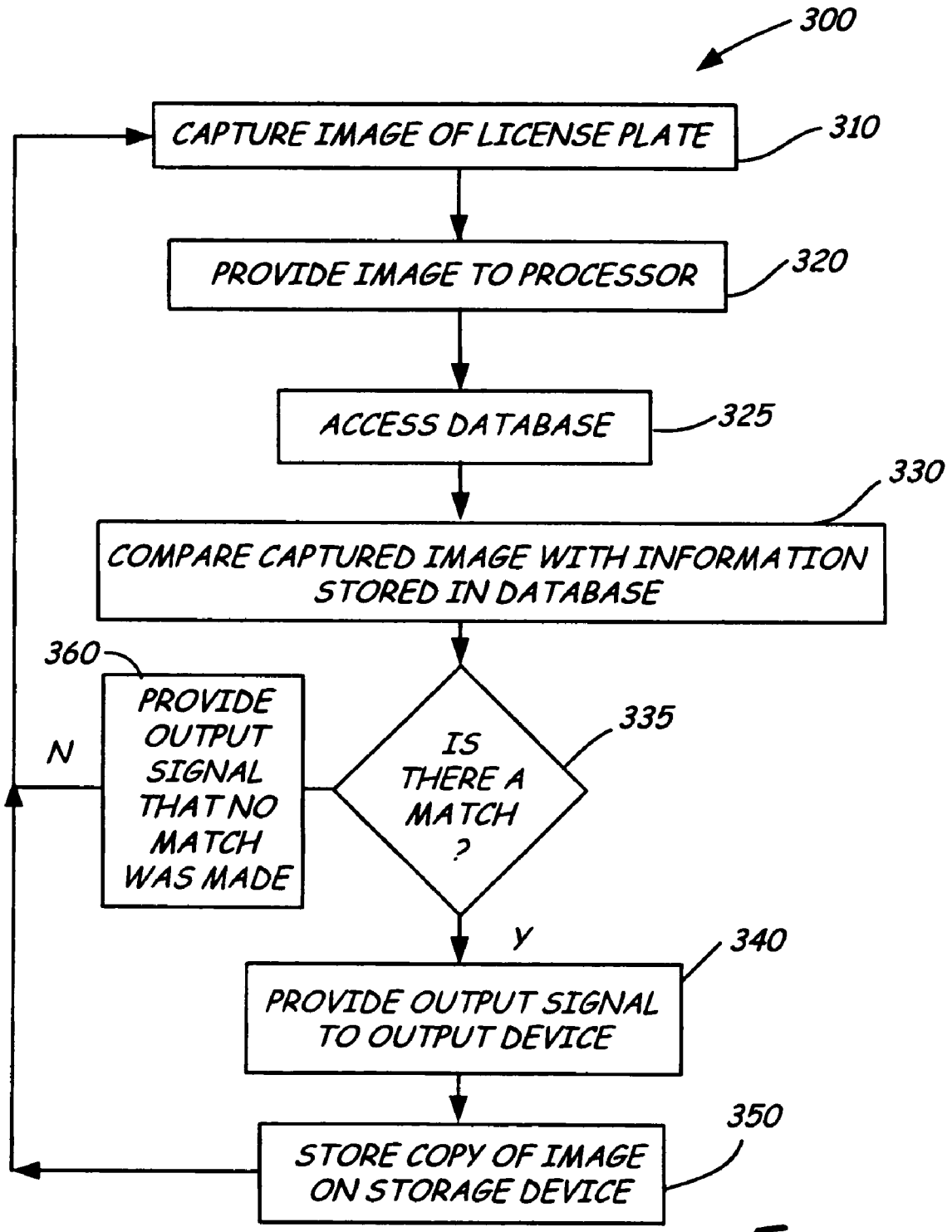
FIG. 3 is a flow diagram illustrating the steps executed by the present invention to identify a license plate.

FIG. 3. is a simplified flow diagram 300 illustrating the steps for identifying a license plate 260 in accordance with one embodiment of the present invention. At 310, camera 210 takes an image 250 of license plate 260. At 320, camera 210 provides the image 250 to processor 220. At 325, database 236 is accessed by processor 220. At 330, the processor 220 compares the image 250 with a list of license plates stored in the database 236 using the comparing routine 270. At 335, processor 320 determines if a match is found in database 236. At 340, an output signal 228 is provided to output device 240 if a match has been identified. At 350, a copy of the image 250 is stored in the match database 238 if a match has been identified. At 360, an output signal 228 is provided to the output device 240 indicating that no match was made.

Figure 4:
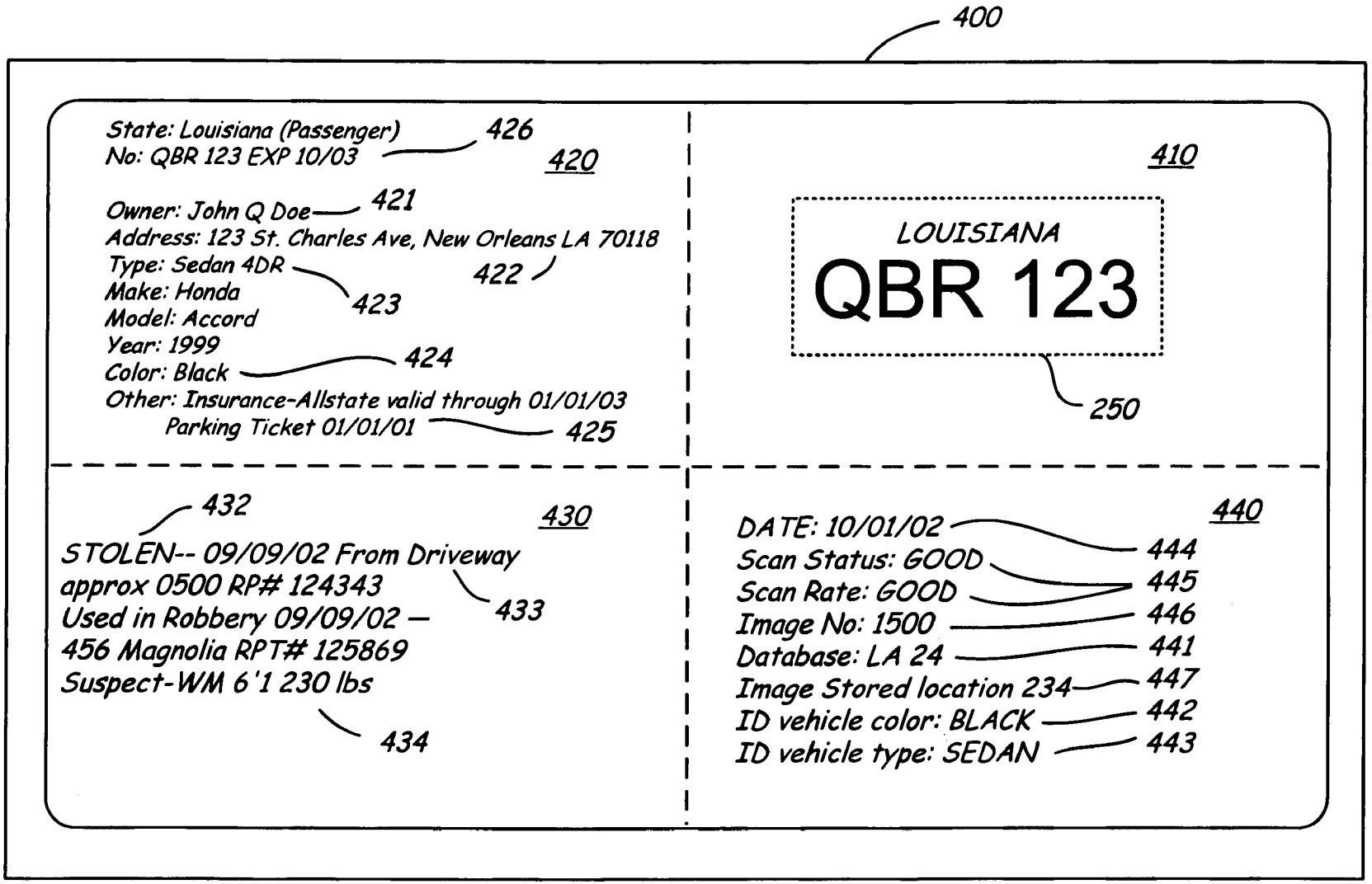
FIG. 4 is a diagrammatic representation of the results of a license plate scan displayed on a display device.

FIG. 4 is a diagrammatic illustration of an output device 240 according to one illustrative embodiment of the present invention. In the embodiment illustrated in FIG. 4, output device 240 provides a visual display through a display device 400 to the law enforcement officer. It should be noted that reference numbers used in FIG. 4 that are the same as used in FIG. 2 represent the same or similar items.

Display device 400 can display several items of information to the officer. While the displayed information illustrated in FIG. 4 is shown in a particular layout it will be recognized by those skilled in the art that the arrangement and contents of the information displayed on display device 400 can be changed or rearranged depending on the needs of the jurisdiction and the information available in database 236.

Display device 400 displays the digital image 250 of the license plate 260 captured by the camera 210, in an upper right hand corner 410 of display device 400. In an upper left hand corner 420 of display device 400 is displayed information related to the scanned license plate. This information can include such items as, the owner's name 421, address 422, vehicle type 423, vehicle color 424, as well as other registration information 425.

On a bottom left portion 430 of display device 400 is displayed information concerning whether the vehicle identified by the system 200 is stolen at location 432, or if there are any other discrepancies associated with the scanned license plate. This information can include such information as to when the vehicle was reported stolen is displayed at location 442, or any crimes the vehicle may have been sighted at is displayed at location 444. If the vehicle is not stolen or there are no discrepancies with the license plate, the display device can display "clear" or other phase indicating to the officer that the vehicle is not of further interest on line 432.

On a bottom right hand side 440 of display device 400 is displayed information related to the scanned plate. This information can include the database 236 that provided the information 441 that the vehicle was stolen. Further, area 440 can provide information about the vehicle currently bearing the identified license plate. This information can include such items as the colour of the vehicle 442, a generic type of vehicle 443 such as car, truck, trailer, etc. Data can also include the date of the scan 444, scan status and quality 445, an image number 446, and a stored location 447 in motion database 238. In other embodiments display device 400 can provide information related to the vehicle currently bearing license plate 260 such as make and manufacturer, using for example, a stored database of vehicle profiles, or by identifying the manufactures name through its name plate on the vehicle.

Figure 5:
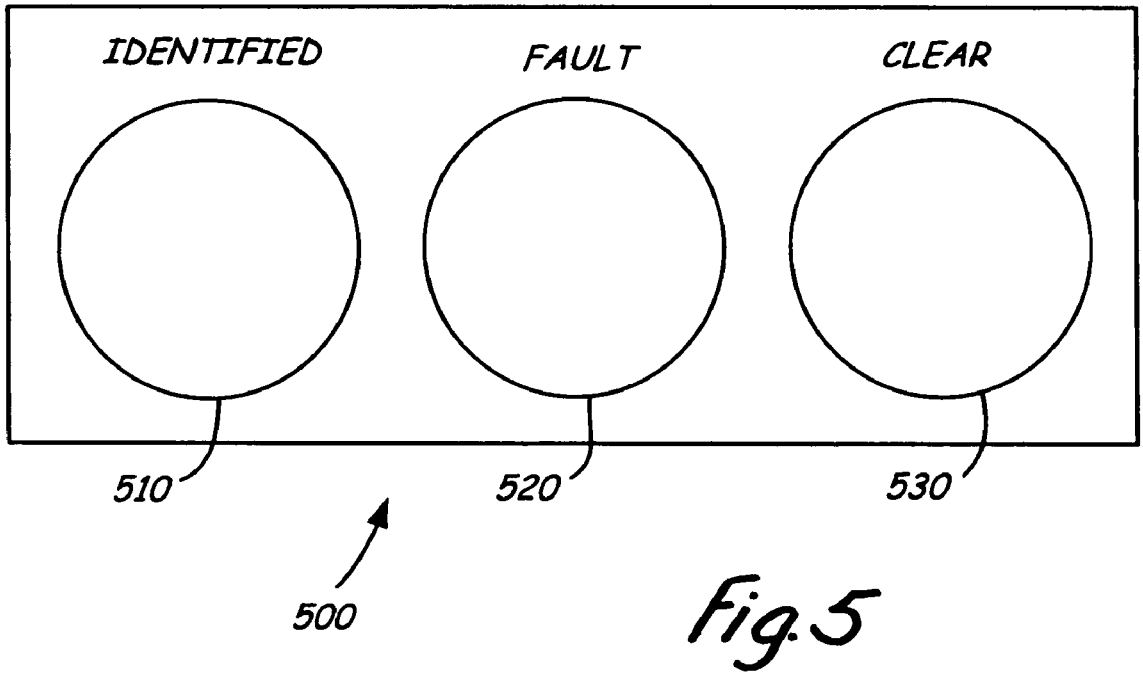
FIG. 5 is diagrammatic illustration representation of a three light display device that is useful in the present invention.

FIG. 5 is a diagrammatic illustration of an output device 500 having a three light indicator system for indicating to the officer the status of any scanned plate according to an alternative embodiment of the present invention. In this embodiment light 510 is a red light, light 520 is a yellow light, and light 530 is a green light. Red light 510 illuminates when system 200 detects that a plate 260 matching a plate in database 236 listed as stolen has been identified. Green light 530 illuminates when the system fails to make a match with a license plate in the database 236 listed as stolen. Yellow light 520 illuminates when the system encounters a technical difficulty. These technical difficulties can include such problems as identifying only part of a license plate, a communications error with the system, or any other fault that can occur in the system. Output device 500 can be combined with output device 400 from FIG. 4 to provide a move efficient and safer system.

FIGS. 6A and 6B are an illustrative example of a system 600 according to the present invention, as installed on a law enforcement vehicle 601. A plurality of cameras 610, 612, 614 are included to provide an increased field of view for detection system 600. Camera 610 is mounted on a right hand portion 611 of front bumper 605 of the law enforcement vehicle. Camera 612 is mounted on a center portion 613 of front bumper 605. In other embodiments the camera can be installed on the areas of the law enforcement vehicle such as the window frame area of the pillar. Camera 614 is mounted on a left hand portion 615 of front bumper 605. Cables 616 lead from cameras 610, 612, 614 to microcomputer 620 located in the trunk 680 of law enforcement vehicle 600. However, depending on the size of microcomputer 620, micro computer 620 can may be located in other areas of vehicle 601.

Microcomputer 620 has three processors 622, 624, and 626. Each processor 622, 624, and 626 is dedicated to one of cameras 610, 612, and 614 respectively. Storage device 630 is integrated into the microcomputer 620. Microcomputer 620 is connected to output device 640 located next to the driver's seat 671 of the law enforcement vehicle 601. Output device 640 is adjustable so that the law enforcement officer can adjust the position of output device 640 to the most convenient and safest position. Communications device 690 is connected to the microcomputer 620, and provides a communications link between the microcomputer 620 and a remote transmission station through antenna 692. Also, power is provided to microcomputer 620 by battery 140.

Figure 7:
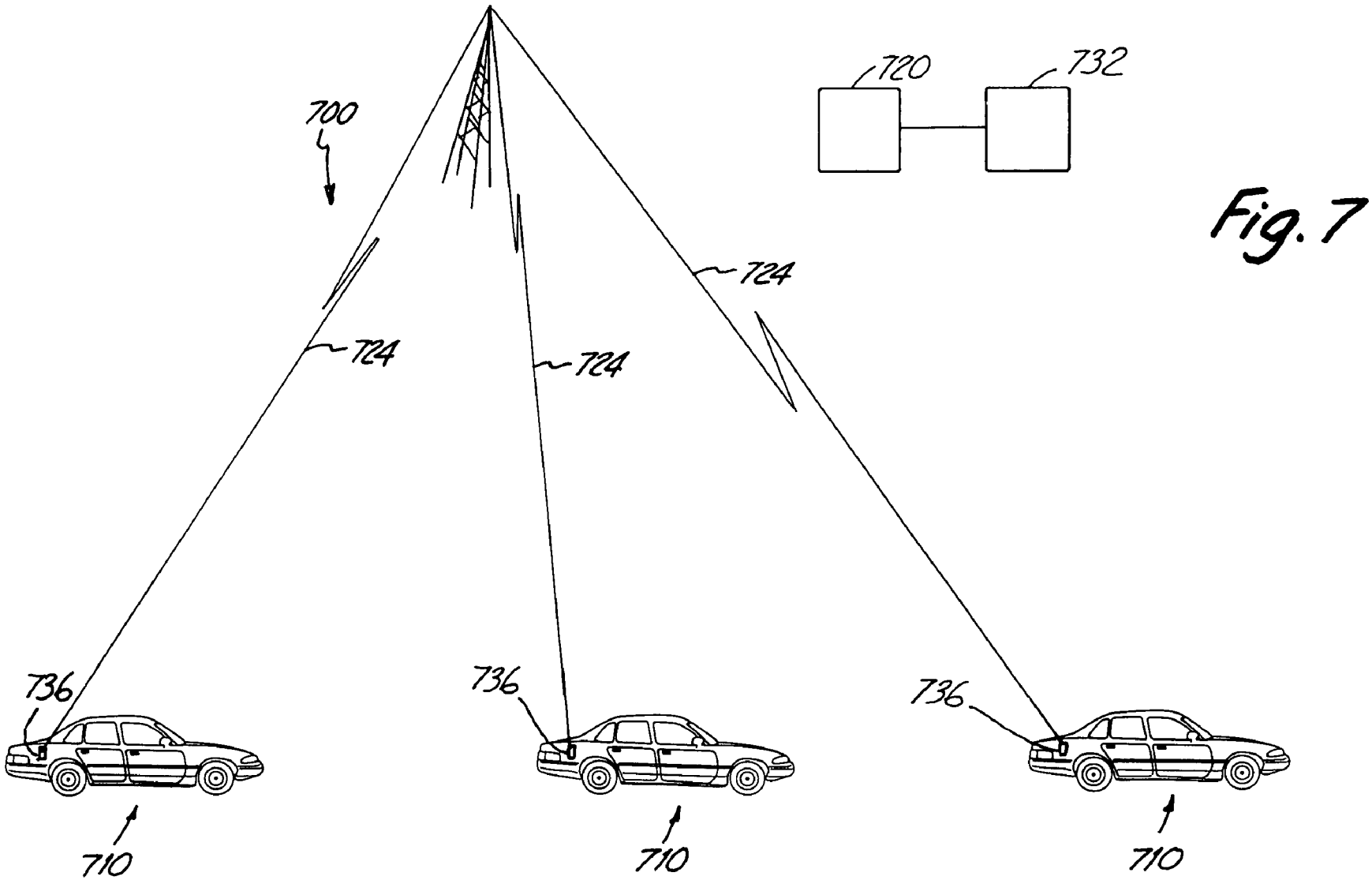
FIG. 7 is a schematic diagram of a transmission system for continuous updating of an onboard stolen vehicle database on a law enforcement vehicle.

FIG. 7 is a simplified illustration of the present invention using a transmission link 700 between law enforcement vehicles 710, 711, 712 and a central computer 720. Transmission link 700 allows a database 736 carried onboard each of the law enforcement vehicles 710, 711, 712 to update continuously, and also permits a central database 732 to receive updated data from law enforcement vehicles 710, 711 and 712. Central database 732 can be updated by any method normally used by the local jurisdiction to update the database 732, such as keying in new entries or downloading a new database. When the central database 732 is updated a signal 724 is sent over transmission link 700 to law enforcement vehicles 710, 711, 712. When signal 724 is received by law enforcement vehicle 710, database 736 carried onboard is updated to reflect any new information contained in signal 724. Signal 724 can use any know format for transmitting information by a radio signal such as GPRS. Further, the vehicles 710, 711, 712 can update the central database 732 when the officer discovers a stolen vehicle.

In summary, the present invention is directed to a law enforcement vehicle 100 having a camera 210 mounted to a portion of the vehicle 100. Camera 210 is configured to identify a license plate 260 on a vehicle that is viewed, and provides an output signal 214 indicative of the identified license plate 160 to a processor 220 carried on the vehicle 100. Processor 220 is configured to receive the signal 214 from camera 210, and compares the received signal 214 with a list of stolen vehicle license plates contained in a database 232. The processor 220 also accesses a storage device 230 containing database 232 of stolen vehicle license plates. The processor 220 is further configured to provide an output signal 228 to an output device 240. Output device 240 is configured to provide an output that is detectable by the law enforcement officer, indicating to the law enforcement that a there is a match. In another embodiment the system is configured to detect a license plate while the law enforcement vehicle is in motion.

Although the present invention has been described with reference to preferred embodiments, workers skilled in the art will recognize that changes may be made in form and detail without departing from the spirit and scope of the invention.

What is claimed is:

1. A law enforcement vehicle comprising:

a camera mounted on the law enforcement vehicle, the camera configured to identify a license plate on a vehicle, the camera further configured to identify additional information related to the vehicle displaying the license plate, and to provide an output signal indicative of the identified license plate and the additional information;

a processor configured to receive a signal from the camera indicative of the identified license plate, and to compare the received signal with a list of vehicle license plates, the processor further configured to compare stored information related to the vehicle with the identified license plate with the additional information provided by the camera;

a storage device coupled to the processor, the storage device configured to provide to the processor the list of vehicle license plates, and the stored information related to the vehicle associated with the license plate; and an output device configured to provide an output detectable by a law enforcement officer indicating that a detected license plate matches a license plate in the list of vehicle license plates or that a discrepancy between the identified license plate and the identified vehicle information was found.

2. The law enforcement vehicle of claim 1 wherein the camera is configured to identify the license plate on the vehicle while the law enforcement vehicle is in motion.

3. The law enforcement vehicle of claim 1 wherein the storage device is further configured to store an image of the vehicle and the license plate of any license plate that matches a license plate in the list of vehicle license plates.

4. The law enforcement vehicle of claim 1 wherein the output device provides detailed information related to the identified license plate.

5. The law enforcement vehicle of claim 4 wherein the output device further provides an audible signal to the law enforcement officer.

6. The law enforcement vehicle of claim 1 wherein the output device provides an audible signal to the law enforcement officer.

7. The law enforcement vehicle of claim 1 further comprising:

a radio transmitter configured to transmit to a central location a signal indicating that the law enforcement vehicle has detected a license plate in the list of vehicle license plates.

8. The law enforcement vehicle of claim 1 wherein the storage device is further configured to receive an updated list of vehicle license plates.

9. The law enforcement vehicle of claim 1:

wherein the camera is configured to provide an image of the vehicle identified to the processor;

wherein the storage device is further configured to provide to the processor information on the vehicle associated with the identified license plate;

wherein the processor is further configured to compare the information on the vehicle with the identified license plate with the image provided by the camera; and wherein the output device is further configured to provide the output signal if the information provided does not match the image.

10. The law enforcement vehicle of claim 1 further comprising:

a plurality of cameras mounted to the law enforcement vehicle, each of the cameras configured to identify a license plate on a vehicle, each of the plurality of cameras providing a signal to the processor indicative of an identified license plate;

wherein the processor is configured to process the signal from each of the plurality of cameras, and to compare each signal with the list of vehicle license plates, and with stored associated information related to the identified license plate.

11. A method of identifying from a law enforcement vehicle, a vehicle, comprising the steps of:

capturing an image of the vehicle with at least one camera;

identifying from the image a license plate area;

obtaining additional information related to the vehicle from the captured image;

determining a character set representative of a license plate number from the identified license plate area;

comparing the determined character set with a database of license plate numbers, wherein the database of license plate numbers includes information related to the vehicle assigned the license plate number; and providing an output indicating that a match is found between the character set and the database.

12. The method of claim 11 further comprising:

providing an output indicating that a match is not found in the database.

13. The method of claim 11 further comprising:

storing a copy of the image in a database of captured images.

14. The method of claim 11 further comprising:

updating the database of license plate numbers from a central database.

15. The method of claim 11 wherein the database of license plate numbers contains license plate numbers associated with stolen vehicles, and wherein the providing step provides output indicating that the identified license plate number is to a stolen vehicle.

16. The method of claim 11 wherein capturing the image captures the image while the law enforcement vehicle is in motion.

17. The method of claim 11 further comprising:

transmitting from the law enforcement vehicle to a central station information related to an identified vehicle that matches a license plate number in the database of license plates numbers.

18. The method of claim 11 wherein the database of license plate numbers contains license plate numbers associated with stolen license plates, and wherein the providing step provides output indicated that the identified license plate is stolen.

19. The method of claim 18 wherein the information related to the vehicle assigned the license plate includes color, make and model of the vehicle, and expiration date of the license plate.

20. A vehicle comprising:

a camera mounted on the vehicle, the camera configured to identify a license plate on a vehicle, the camera further configured to identify additional character information related to the vehicle displaying the license plate, and to provide an output signal indicative of the identified license plate and the additional information;

a processor configured to receive a signal from the camera indicative of the identified license plate, and to compare the received signal with a list of vehicle license plates, the processor further configured to compare stored information related to on the vehicle with the identified license plate with the additional information provided by the camera;

a storage device coupled to the processor, the storage device configured to provide to the processor the list of vehicle license plates, and the stored information related to the vehicle associated with the license plate; and an output device configured to provide an output detectable by a law enforcement officer indicating that a detected license plate matches a license plate in the list of vehicle license plates or that a discrepancy between the identified license plate and the identified vehicle information was found.

* * * * *

UNITED STATES PATENT AND TRADEMARK OFFICE

CERTIFICATE OF CORRECTION

PATENT NO. : 6,982,654 B2
APPLICATION NO. : 10/713995
DATED : January 3, 2006
INVENTOR(S) : Rau et al.

It is certified that error appears in the above-identified patent and that said Letters Patent is hereby corrected as shown below:

On The Title page:

Item Abstract (57)

Line 5, change "160" to --260--.

Claim 20

Col. 11, line 5, delete "on"

Signed and Sealed this

Fifth Day of September, 2006

JON W. DUDAS
*Director of the United States Patent and Trademark Office*